United States Patent [19]

Reifers et al.

[11] 4,059,219

[45] * Nov. 22, 1977

[54] EGG CARTON

[75] Inventors: Richard F. Reifers, New Canaan, Conn.; Kenneth D. Bixler, Huntington, N.Y.; Henry A. Lord, Cape Elizabeth, Maine

[73] Assignee: Diamond International Corporation, New York, N.Y.

[ * ] Notice: The portion of the term of this patent subsequent to May 24, 1994, has been disclaimed.

[21] Appl. No.: 688,000

[22] Filed: May 19, 1976

Related U.S. Application Data

[63] and a continuation-in-part of Ser. No. 654,017, Jan. 30, 1976, Continuation-in-part of Ser. No. 609,078, Aug. 29, 1975.

[51] Int. Cl.[2] ..... B65D 1/24; B65D 5/48

[52] U.S. Cl. ..... 229/2.5 EC; 229/29 M; 229/44 EC; 229/45 EC; 217/26.5

[58] Field of Search ..... 229/2.5 EC, 29 M, 44 EC, 229/45 EC; 317/26.5, 27

[56] References Cited

U.S. PATENT DOCUMENTS

| | | | |
|---|---|---|---|
| 1,846,561 | 2/1932 | Koppelman | 229/29 M |
| 2,100,516 | 11/1937 | Read | 229/25 EC |
| 3,131,846 | 5/1964 | Whiteford | 229/2.5 EC |
| 3,645,436 | 2/1972 | Boyd et al. | 229/44 EC |
| 3,672,693 | 6/1972 | Weir | 229/25 EC |
| 3,741,461 | 6/1973 | Hassing-Hansen | 229/2.5 EC |

*Primary Examiner*—William Price
*Assistant Examiner*—Douglas B. Farrow
*Attorney, Agent, or Firm*—Karl W. Flocks

[57] ABSTRACT

A molded egg carton having a windowed cover and a cellular tray for the reception of eggs in which the windowed cover includes downposts and the tray includes up posts and in which the downposts have an offset male portion and the up posts are formed with a recess in their uppermost portion adapted to receive the offset lowermost tip of the offset male portion. The windows in the cover are on each side of the downposts and are set in relatively steep walls which form parts of the downposts. The windows are provided with "eye lid" formations.

10 Claims, 4 Drawing Figures

EGG CARTON

This application is a continuation-in-part of applicants' pending application Ser. No. 609,078, filed Aug. 29, 1975, and applicants' pending application Ser. No. 654,017 filed Jan. 30, 1976.

BACKGROUND OF THE INVENTION

This invention relates to new and improved molded egg carton construction which may be formed from pulp or foam or the like. More particularly, this invention relates to a carton of the type having viewing apertures or windows, but having greater strength and product protection characteristics than the known constructions of this type.

The construction of the egg carton is suitable for what is known in the trade as a 2 × 6 egg carton or a 2 × 5 egg carton or a "twin-6er" which comprises separable sections each of which contain six cells in two rows of three each.

SUMMARY OF THE INVENTION

The present invention has been conceived with an aim toward providing an egg carton construction or the like having viewing apertures or windows, which construction is characterized by more positive separation of eggs or like contents thereof.

The present invention has also been conceived with the object of providing a carton with improved stacking strength over that of the known cartons of this type.

Another object of the present invention is to provide a more stable tray and cover arrangement in a carton, one in which the cover may be in a sense locked to the tray against misalignment therebetween Still another object of the present invention is to provide a cellular tray construction in an egg carton which will aptly accommodate a wide size range of eggs from small sizes to extra large sizes and yet adequately cushion and protect whatever sizes are received therein.

Yet another object of the present invention is to provide an egg carton with cell post elements of such construction as will separate and guide eggs in the automated loading operation.

A further object of the present invention is to provide an egg carton construction characterized by improved strength and force transmission from cover to the cells.

It is moreover an object of the present invention to provide an egg carton with post construction including a soft area at the critical point of egg contact which will result in better cushioning.

DETAILED DESCRIPTION OF THE INVENTION

Figure 1:
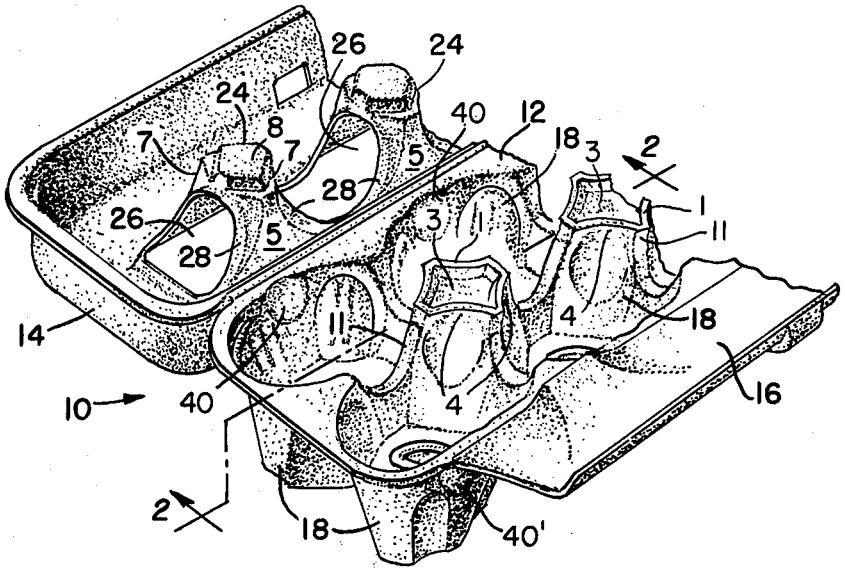
FIG. 1 is a fragmentary view in perspective of one form of the present invention.
Figure 2:
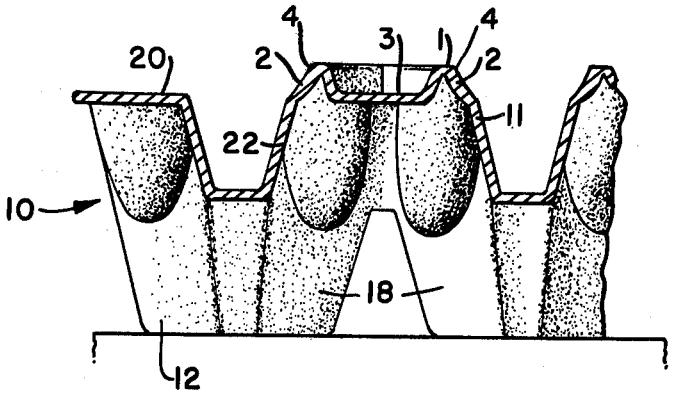
FIG. 2 is a view taken along section 2—2 of FIG. 1 on an enlarged scale.

Referring now more particularly to the drawings, the reader will readily see in FIGS. 1–4 that the present invention comprises a molded carton 10 of pulp or foam or the like. In a preferred embodiment of the invention, carton 10 includes a cellular tray 12, a cover 14, and a lock flap 16. The tray 12 is formed with a plurality of cells 18 in which eggs or the like may be protectively contained. The cells 18 are generally polygonal and in the present embodiment are at least five-sided with one of the sides of each end cell being provided on or associated with an upwardly extending member referred to as an up post 11 and each of two sides of each intermediate cell being provided on or associated with one of two adjacent up posts 11. Tray 12 includes a generally horizontal flange 20 on which cover 14 rests as it is closed in mating condition with tray 12. In the closed mating condition of cover 14 and tray 12 up post 11 extends upwardly beyond flange 20 to an uppermost tip or rim portion 1 which extends above and beyond the cellular portion of tray 12.

In the uppermost portion of the up post 11 there is a crater or crater-like formation 3. Each up post 11 has side walls with non-uniform inner and outer sides which may be seen in FIG. 2 as a bulging portion 2 near the top of the up post 11 where the bulging portion 2 of the side wall of the up post 11 is thicker than the lower portion 22 of the up post 11.

The up posts 11 separate the eggs and guide the eggs when they are automatically loaded into the carton 10. The up posts 11 provide egg separation during shipment.

The cover 14 which mates with the tray 12 over the egg cells 18 includes downwardly extending downposts 24 in the closed condition of cover 14. On each side of each downpost 24 there is an aperture or window 26 through which contents of the carton 10 may be viewed even when the cover 14 is closed. Each downpost 24 extends to a tip 8 that is set inwardly so as to fit within crater 3 at the uppermost tip or rim portion 1 of an up post 11.

Figure 3:
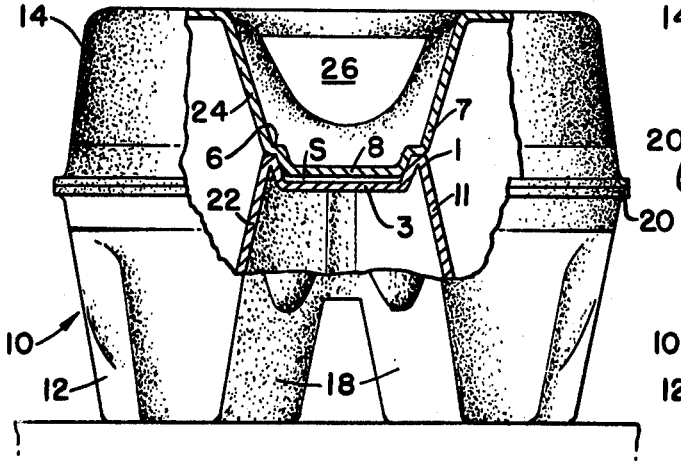
FIG. 3 is an end view of the carton of FIG. 1 in a closed condition and on an enlarged scale.
Figure 4:
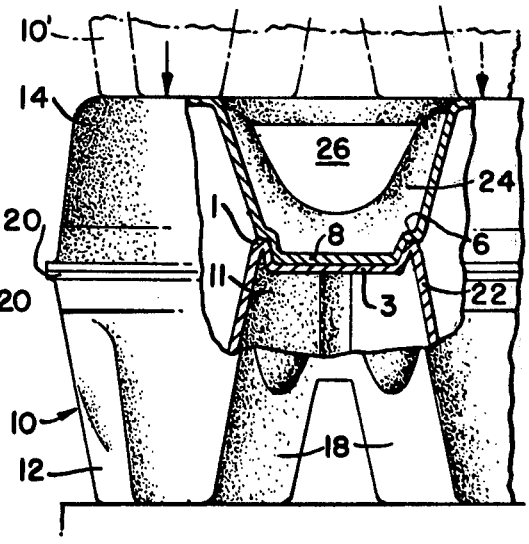
FIG. 4 is a fragmentary end view of the carton in FIG. 3 showing the effect of loaded cartons stacked thereon.

It is noted in FIG. 3 that when the cover 14 of the egg carton is first closed the very tip 8 of the downposts 24 do not touch the bottom of the crater 3 in the up posts 11 and there is a space S initially between the very tip 8 of the downposts 24 and the crater 3 of the up posts 11 when the carton 10 is first closed. After the carton 10 is loaded with eggs and closed and other cartons 10' loaded with eggs are stacked as illustrated in FIG. 4 in an egg case for shipment, a shoulder 6 of the downpost 24 first engages the tip or rim 1 of the crater 3 on the up post 11 and then if the loading is sufficiently heavy, the tip 8 of the downpost 24 may touch the bottom of the crater 3 of the up post 11 with no space S therebetween.

The cover 14 when closed shows the windows 26 as having "eye lid" formations 28 which extend from walls 5 forming sides of the downposts 24, which walls 5 are steeper than corresponding walls of prior cartons of this type. The increase in steepness of walls 5 over that of prior art cartons allows for more direct transmission of force, due to stacking for example as will be discussed further herein, and also locates the shoulder 6 at the downpost 24 in a position more centrally between eggs to provide better egg separation and protection.

The stepped mating formation between the downpost 24 and the up post 11 transmits load in an advantageous manner in that the initial force transmission is associated with the horizontal portion of the shoulder 6 and the crater tip or rim 1 of up post 11. A secondary bearing area is provided as the downpost tip 8 contacts the bottom of the crater 3 of the up post 11 upon additional loading. A side wall portion 7 of side wall 5 provides added separation structure for protection of the eggs. Inasmuch as carton 10 is of such construction that a space S is provided between tip 8 of each downpost 24 and the bottom of crater 3 of an up post 11, such space S is the result of shoulder 6 of downpost 24 being seated on rim 1 of up post 11. As a result of this construction vertical force due to loaded cartons stacked on each such carton is directed to the strongest portion of up post 11, namely rim 1. As additional cartons are stacked thereon the vertical force may increase to the point that the space S disappears and stacking force will then also be transmitted from downpost 24 through the tip 8 of downpost 24 onto the bottom or floor of crater 3 so that force resistance is tightened by indirect force transmission through the remaining area of up post 11. Such result only occurs when forces are high, as the space or gap S generally exists in normal handling of the carton 10. It is clear that such construction affords shock absorbing characteristics in a carton, which characteristics are comparable to controlled crushing characteristics built into certain automobiles being built, wherein automobile occupants would be protected by progressively tightening of the vehicle in case of collision.

When the carton 10 is closed and in use, the structure recited interacts to produce complete egg protection in a manner superior to that available in previous carton structures. The egg separation produced by the cover downposts 24 and the tray up posts 11 are positive. The vertical stacking strength of the carton 10 exceeds that of previous egg cartons. The stepped in formation of the tip 8 of the downposts 24 and the crater 3 formation of the top of the up posts 11 contribute to this strength. The additional thickness in bulging portion 2 at the upper end of the up posts 11 contributes to the strength. The downposts 24 of the cover 14 lock into the crater 3 of the up posts 11 of the tray 12 and stabilize the cover 14 against mis-alignment to maintain package strength in a novel manner different from a straight line engagement in the sense that the engagement takes place in the shape of a closed geometric configuration.

An important advantage of crater 3 resides in the fact that a yieldable or soft area 4 is provided in up post 11 along each side thereof at the critical point of egg contact. The effect of yieldable or soft area 4, as provided in the present invention, is in contrast to a more rigid and relatively unyieldable area of contact where a plateau would be extended straight across the top of up post 11 instead of the crater 3 of the present application. This yieldable or soft area 4 formed adjacent the uppermost tip 1 of up post 11 faces into cell 18. As seen in FIG. 1 yieldable or soft area 4 is formed with a concave egg contacting surface which can be significant where the carton is to receive very large eggs since the concave surface provides added cell space and better cushioning for the egg due to a wider area of contact than would be provided of the post 11 were formed with a plane surface or a convex surface which would present point contact with an egg. The wider area of contact thus provided also effects better impact or horizontal force distribution. On the opposite side of each yieldable area 4, the generally vertical inner wall portion of crater 3 is seen to be generally convex in FIG. 1.

From the foregoing construction of carton 10, it may be now appreciated that up posts 11 are provided with a crater 3 which in cooperation with the downposts 24 of cover 14 provide greater visibility and more direct transmission of vertical forces while maintaining a soft egg contact surface 2 and allowing the edge of up post 11 to be raised beyond the level of corresponding edges of prior cartons of this type to provide better separation of eggs in automated loading operations. This added height is of significance when coupled with the wide shoulder dimension of the post edge. In certain egg automation processes, the egg is "lobbed" into its cell rather than dropped therein, consequently the high and wide posts in the present invention are advantageous in ensuring that eggs are caught and guided without contact with eggs of neighboring cells.

To further provide added cell space concave bubbles 40 are formed at the upper edge of each cell 18 on opposite sides of the tray 12 adjacent the hinge area between the cell 18 and the lock flap 16. The bubbles 40 appear as convex protuberances 40′ on the outside of the tray 18.

It will be obvious to those skilled in the art that various changes may be made without departing from the scope of the invention and the invention is not to be considered limited to what is shown in the drawings and described in the specification.

What is claimed is:

1. In an egg carton comprising a tray, a cover and a lock flap hinged thereto on opposite sides thereof and having one or more downposts in the cover and one or more up posts with cells extending therearound in the tray, apertures formed on each side of a downpost, "eye lids" about the aperture formations, said "eye lids" extending from relatively steep walls in the cover, said downposts having a stepped in shoulder on a plug-like formation with a tip extending therefrom at its extremity, each tray up post having a recess or crater-like formation at its upper extremity adapted to receive the tip of each downpost with said shoulder seated on the upper extremity of an up post when said cover is closed, the upper portions of the side walls of the up posts including generally concave yieldable areas facing into each cell extending therearound, the tip of each downpost and the bottom of the crater of each up post associated therewith being spaced apart from each other a distinct distance when the cover is initially closed with the distinct distance disappearing when a load of such magnitude as that of a plurality of loaded egg cartons are stacked thereon.

2. In an egg carton as defined in claim 1, wherein opposite sides of said generally concave yieldable areas of the upper portions of the side walls of the up posts are generally convex and form inner walls of said crater.

3. In an egg carton as defined in claim 2, wherein a concave bubble is provided in each cell along at least one side of said carton at the upper edge thereof adjacent a hinge area.

4. In an egg carton comprising a tray on which eggs or the like may be protectively stored and a cover adapted to close over said tray, said tray being of cellular construction and including one or more up posts, each of said one or more up posts having a recess or crater-like formation at its extremity in the form of a closed polygon, each of said one or more up posts also having side walls with upper portions that are generally concave facing into an adjacent cell, said cover when considered from a closed condition thereof having one or more downposts, each of said one or more downposts having a stepped in plug-like formation at its extremity, the crater-like formation of each of said one or more up posts being adapted to receive the stepped in plug-like formation of said one or more downposts, each of said one or more downposts further having oppositely facing apertures formed on two sides thereof and eye lid-like portions extending about the apertures from relatively steep walls on said cover, the extremity of said one or more downposts and the bottom of the crater of said one ore more up posts being spaced apart from each a distinct distance when the cover is initially closed with said distance being closed to a greater degree ot disappearing from the load of one or more cartons loaded with eggs stacked on top of said cover.

5. The construction as defined in claim 4, wherein said one or more up posts and said one or more downposts are in fact a plurality of longitudinally spaced up posts along the length of said tray and a plurality of longitudinally spaced downposts along the length of said cover, and said generally concave upper portions are yieldable or softer than other areas of said up posts.

6. The construction as defined in claim 5, wherein said generally concave upper portions define said crater-like formation with opposite sides of said generally concave upper portions being generally convex and forming inner walls of said crater-like formation.

7. The construction as defined in claim 6, wherein said tray includes concave bubble members formed at upper wall portions of each cell adjacent to hinge areas for said cover.

8. The construction as defined in claim 7, wherein the area around the top of each of said up posts is of greater thickness than that around the lower portions of said up posts.

9. The carton as defined in claim 8, wherein the carton is formed from pulp, foam or like material.

10. In an egg carton having a tray and a cover with one or more downposts in the cover and one or more up posts in the tray, apertures formed on each side of a downpost, "eye lid" formations extending about the apertures, said "eye lid" formations extending from relatively steep walls in the cover, said downposts having a stepped in plug-like formation at its extremity, each tray up post having a recess or crater-like formation at its extremity adapted to receive the tip of each downpost, the upper portions of the side walls of the up posts including generally concave yieldable areas facing into adjacent cells with opposite sides of said concave areas being convex, said cover being constructed so that upon being initially closed a space between the tip of the downpost and the bottom of the crater of the up post will be maintained, which space may be closed so as to disappear when sufficiently loaded as by a plurality of loaded egg cartons stacked upon the closed cover.

* * * * *